US011077983B2

(12) United States Patent
Giraud et al.

(10) Patent No.: US 11,077,983 B2
(45) Date of Patent: Aug. 3, 2021

(54) PACKAGING AND PACKAGING BLANK

(71) Applicant: Intercontinental Great Brands LLC, East Hanover, NJ (US)

(72) Inventors: Alain Giraud, Saclay (FR); Olivier Kintzig, Saclay (FR)

(73) Assignee: Intercontinental Great Brands LLC, East Hanover, NJ (US)

( * ) Notice: Subject to any disclaimer, the term of this patent is extended or adjusted under 35 U.S.C. 154(b) by 0 days.

(21) Appl. No.: 16/416,058

(22) Filed: May 17, 2019

(65) Prior Publication Data

US 2019/0270538 A1 Sep. 5, 2019

Related U.S. Application Data

(62) Division of application No. 15/037,041, filed as application No. PCT/IB2014/002795 on Nov. 24, 2014, now Pat. No. 10,377,522.

(30) Foreign Application Priority Data

Nov. 26, 2013 (GB) ..... 1320803
Jun. 19, 2014 (GB) ..... 1410937

(51) Int. Cl.
*B65D 5/06* (2006.01)
*B65D 75/12* (2006.01)
(Continued)

(52) U.S. Cl.
CPC ..... *B65D 5/067* (2013.01); *B65B 5/024* (2013.01); *B65D 5/4266* (2013.01); *B65D 75/06* (2013.01);
(Continued)

(58) Field of Classification Search
CPC ..... B65D 5/067; B65D 5/4266; B65D 75/06; B65D 75/5855; B65D 85/60; B65D 5/024; B65D 5/061; B65D 5/064; B65D 5/06
(Continued)

(56) References Cited

U.S. PATENT DOCUMENTS 356,747 A * 2/1887 Clark ..... B65D 5/061 229/137
1,994,923 A * 3/1935 Ross ..... B65D 33/18 229/137
(Continued)

FOREIGN PATENT DOCUMENTS

CN 2813510 9/2006
CN 202098602 1/2012
(Continued)

OTHER PUBLICATIONS

Examination Opinion dated Dec. 16, 2014 for Application No. GB1410937.5 (1 pg.).
(Continued)

*Primary Examiner* — Christopher R Demeree
(74) *Attorney, Agent, or Firm* — Fitch, Even, Tabin & Flannery LLP

(57) ABSTRACT

The invention provides a packaging comprising opposing and spaced apart front and back panels separated by side panels extending therebetween, wherein a marginal sealing region of each end of the front and back panels is sealed together and wherein at least a portion of an edge of at least one end of the side panels is not connected to the marginal sealed regions of the front and back panels, and, wherein the panels are formed from cartonboard.

12 Claims, 5 Drawing Sheets

(51) Int. Cl.

| | |
|---|---|
| ***B65D 5/42*** | (2006.01) |
| ***B65D 75/06*** | (2006.01) |
| ***B65D 75/58*** | (2006.01) |
| ***B65D 85/60*** | (2006.01) |
| ***B65B 5/02*** | (2006.01) |

(52) U.S. Cl.
CPC ..... *B65D 75/12* (2013.01); *B65D 75/5855* (2013.01); *B65D 85/60* (2013.01)

(58) Field of Classification Search
USPC ..... 229/213, 137, 184, 249, 125.42, 132; 383/104, 119
See application file for complete search history.

(56) References Cited

U.S. PATENT DOCUMENTS

| | | | | | |
|---|---|---|---|---|---|
| 2,156,441 | A | | 5/1939 | Watson | |
| 3,055,574 | A | | 9/1962 | Johnson | |
| 3,349,988 | A | * | 10/1967 | Horning | B65D 5/068 229/249 |
| 3,465,946 | A | | 9/1969 | Johnson | |
| 3,485,435 | A | | 12/1969 | Densen | |
| 3,486,682 | A | | 12/1969 | Mahon | |
| 3,885,729 | A | | 5/1975 | Cowen | |
| 3,913,826 | A | * | 10/1975 | Brownlee | B65D 5/064 229/184 |
| 4,090,607 | A | | 5/1978 | McCall | |
| 4,903,892 | A | | 2/1990 | McNair | |
| 5,437,406 | A | * | 8/1995 | Gordon | B65D 5/18 229/104 |
| 5,501,394 | A | | 3/1996 | Eno | |
| 5,704,541 | A | * | 1/1998 | Mogard | B65D 5/746 229/125.15 |
| 6,016,953 | A | * | 1/2000 | Stacy-Ryan | B65D 5/06 229/113 |
| 6,105,773 | A | * | 8/2000 | Miller | B65D 71/40 206/431 |
| 6,520,404 | B1 | * | 2/2003 | Waldburger | B65D 5/064 229/137 |
| 6,726,088 | B2 | | 4/2004 | Waldburger | |
| 7,556,191 | B2 | * | 7/2009 | Hewitt | B65D 77/28 229/103.1 |
| 8,302,846 | B2 | * | 11/2012 | Koeda | B65D 5/067 229/125.42 |
| 8,814,034 | B2 | * | 8/2014 | Dickie | B65D 5/746 206/459.5 |
| 8,851,361 | B2 | | 10/2014 | Daley | |
| 9,399,536 | B2 | * | 7/2016 | Bertone | B65D 5/068 |
| 9,403,618 | B2 | | 8/2016 | Dolby | |
| 9,611,065 | B2 | * | 4/2017 | Franic | B65D 5/746 |

FOREIGN PATENT DOCUMENTS

| | | | | |
|---|---|---|---|---|
| DE | 202012000270 | | 3/2012 | |
| FR | 758928 | | 1/1934 | |
| GB | 808223 | | 1/1959 | |
| GB | 970066 | | 9/1964 | |
| GB | 1009251 | | 11/1965 | |
| GB | 2513011 | | 10/2014 | |
| WO | 9610479 | | 4/1996 | |
| WO | WO-9610479 | A1 * | 4/1996 | B29C 66/1122 |
| WO | 02030762 | | 4/2002 | |
| WO | 2006010479 | | 2/2006 | |

OTHER PUBLICATIONS

International Search Report and Written Opinion of the International Searching Authority, dated Nov. 20, 2017 for International Application No. PCT/US2017/046759 (8 pgs.).
Noification of the First Office Action, dated Apr. 24, 2017, for Chinese Patent Application No. 201480063442.9, with English translation (14 pgs.).
Search Report under Section 17 dated Apr. 3, 2014 for Application No. GB1320803.8 (1 pg.).
Search Report under Section 17, dated Dec. 15, 2014 for Application No. GB1410937.5 (2 pgs.).

* cited by examiner

PACKAGING AND PACKAGING BLANK

CROSS REFERENCE TO RELATED APPLICATION

This application is a divisional of U.S. patent application Ser. No. 15/037,041, filed May 16, 2016, which is a U.S. national phase application of International Application No. PCT/IB2014/002795, filed Nov. 24, 2014, which claims benefit from United Kingdom Applications 1320803.8, filed Nov. 26, 2013 and 1410937.5, filed Jun. 19, 2014, which are hereby incorporated by reference in their entireties.

TECHNICAL FIELD OF THE INVENTION

The present invention relates to cartonboard-based packaging and blanks for the same. The invention also relates to methods of forming packaging from packaging blanks and filled packaging.

BACKGROUND TO THE INVENTION

It is known to provide so-called flow-wrap packaging which consists of a flexible container comprising front and back panels, side panels, and sealed at either end, normally with crimping or embossing to provide patterned sealing portions.

In general, this type of flow-wrap packaging is manufactured by horizontal or vertical form, fill and seal processes. In horizontal fill, form and seal processes flexible packaging film is run through machinery which folds the material around a product and then clamps and seals the ends of the folded material followed by cutting, to provide a sealed packaging. Such packaging can be run through appropriate machinery relatively rapidly, in order to produce many filled packages per minute.

Conversely, there are many types of cartonboard-based packaging which are formed from cartonboard blanks, and folded to provide a packaging container which may then be sealed by appropriate means. Examples of cartonboard cardboard packaging include standard cartonboard boxes, shelf-ready packaging and the like for example.

Up to now, it has not been thought possible to provide cartonboard-based packaging which mimics the shape and appearance of flow-wrapped packaging made by standard horizontal or vertical form, fill and seal processes.

It would therefore be advantageous to provide a cartonboard-packaging which mimics the shape and appearance of standard flow-wrap packaging, whilst being economical and simple to produce from cartonboard blanks, preferably using standard cartonboard packaging apparatus.

In addition, it would be advantageous to provide cartonboard packaging in which the crimped or patterned end fin portions of flow-wrapped packaging are present, in order to provide a generally authentic flow-wrap look to the cartonboard packaging, and which are easy to open despite the increased thickness of the material compared to standard film seals.

It is therefore an aim of embodiments of the present invention to overcome or mitigate at least some of the problems of the prior art.

SUMMARY OF THE INVENTION

According to a first aspect of the present invention there is provided a packaging comprising opposing and spaced apart front and back panels separated by side panels extending therebetween, wherein a marginal sealing region of each end of the front and back panels is sealed together and wherein at least a portion of an edge of at least one end of the side panels is not connected to the marginal sealed regions of the front and back panels, and wherein the panels are formed substantially from cartonboard.

In some embodiments at least a portion of an edge of an end of both side panels is not connected to the marginal sealed regions. In yet other embodiments at least a portion of an edge of both ends of both side panels is not connected to the marginal sealed regions.

In some embodiments at least one end of at least one side panel or both side panels comprises at least one cut-out region or aperture, the edge or edges of which are not connected to the marginal sealed regions of the front and back panels.

In some embodiments at least one end of at least one side panel or both side panels comprises a plurality of cut-out regions or apertures, the edge or edges of which are not connected to the marginal sealed regions of the front and back panels.

In some embodiments each of the panels consists essentially of cartonboard, but may include minor amounts of other materials such as a laminated film on one or both sides thereof, printed material or the like, for example.

The marginal regions of the front and back panels may be sealed by way of a reclosable seal or a peelable seal. The seal may be formed by way of a peelable adhesive, which may be re-sealable adhesive, such as a heat-sensitive adhesive, a cold seal adhesive, or the like, for example. In alternative embodiments, or in addition to use of an adhesive, the seal may be formed from a weld, such as a peelable weld.

In other embodiments the marginal regions of the front and back panels may be sealed by means of a mechanical seal such as a zip lock, finger press sealing strip, grip seal of the like, for example.

In some embodiments a re-sealing tab may be provided for securing the marginal regions together after initial opening. The tab may have an adhesive on at least one face by means of which the tab is secured to the outside of the marginal portions or front or back panel to couple and secure the portions together.

The sealed marginal portions may be crimped or embossed along at least a portion thereof and in some embodiments along substantially the whole of the marginal portions. Crimping or embossing the sealed marginal portions, in addition to the configuration of the overall structure of the packaging enables the cartonboard packaging to look identical or substantially identical to equivalent polymeric flow-wrap packaging formed by conventional horizontal or vertical fill, form and seal processes.

The side panels may comprise substantially planar panels. In other embodiments the side panels may comprise a crease or fold-line extending therealong. By providing side panels comprising fold lines extending therealong, this may enable the packaging to be substantially flattened before filling with a product, during storage and transport, or to gradually flatten after products are removed therefrom.

In some embodiments the end regions of the side panels comprise gabled end regions. The gabled end regions of the side panels may comprise a crease or fold-line. In some embodiments the gabled end region comprises a quadrilateral panel comprising a triangular or V-shaped fold-line configuration. This configuration enables the gabled end region to fold between the front and back panels, in use, in order to provide the partially sealed end regions of the packaging, whilst enabling the side panels to remain substantially perpendicular to the front and back panels.

The inclusion of at least a portion of an edge of the side panels which is not connected to the sealed marginal regions enables a user to push his or her fingers against the end of the side panel to gain greater leverage in pushing apart the sealed ends of the front and back panels. If an opening or cut-out is present in the edge, this gives a user further room to insert his or her fingers.

According to a second aspect of the invention there is provided a packaging comprising opposing and spaced apart front and back panels separated by side panels extending therebetween, a region at each end of the side panels comprising a gusseted region, wherein a marginal region of each end of the front and back panels is sealed together and with the gusseted region of the side panels form sealed end regions of the packaging, and wherein the panels are formed substantially from cartonboard.

In some embodiments each of the panels consists essentially of cartonboard, but may include minor amounts of other materials such as a laminated film on one or both sides thereof, printed material or the like, for example.

The marginal region of each end of the front and back panel may comprise an integral marginal region or a fin region connected or integral with the panels.

The marginal regions of the front and back panels may be sealed by way of a reclosable seal or a peelable seal. The seal may be formed by way of a peelable adhesive, which may be re-sealable adhesive, such as a heat-sensitive adhesive, a cold seal adhesive, or the like, for example. In alternative embodiments, or in addition to use of an adhesive, the seal may be formed from a weld, such as a peelable weld.

In other embodiments the marginal regions of the front and back panels may be sealed by means of a mechanical seal such as a zip lock, finger press sealing strip, grip seal of the like, for example.

In some embodiments a re-sealing tab may be provided for securing the marginal regions together after initial opening. The tab may have an adhesive on at least one face by means of which the tab is secured to the outside of the marginal portions or front or back panel to couple and secure the portions together.

The sealed marginal portions may be crimped or embossed along at least a portion thereof and in some embodiments along substantially the whole of the marginal portions. Crimping or embossing the sealed marginal portions, in addition to the overall structure of the packaging enables the cartonboard packaging to look identical or substantially identical to equivalent polymeric flow-wrap packaging formed by conventional horizontal or vertical fill, form and seal processes.

The side panels may comprise substantially planar panels. In other embodiments the side panels may be gusseted and may comprise a crease or fold-line extending therealong, which may be contiguous with the marginal gusseted region of the side panels. Gusseted side panels may enable the packaging to be flattened before filling with a product, during storage and transport, or to gradually flatten after products are removed therefrom.

The marginal, gusseted region of the side panels may comprise a crease or fold-line, and may include a triangular fold configuration extending from the crease or fold-line. This configuration enables the marginal, gusseted region to fold between the front and back panels, in use, in order to provide the sealed end regions of the packaging, whilst enabling the side panels to remain substantially orthogonal to the front and back panels.

The packaging may comprise fins extending along at least a portion of the junction of the front and back panels and side panels. The fins may be formed from a crease or fold line in the front and back panels and/or side panels adjacent the join between the front and back panels and the side panels.

According to a third aspect of the invention there is provided a packaged product comprising a packaging of the first or second aspects of the invention containing at least one product or item.

The product or item may be a food item, which may comprise a secondary packaging such as a wrapper or the like, for example. The food item may be a confectionery item, bakery item, fruit, vegetable, meat, cheese, snack item, or the like. Suitable confectionery items include chocolate, chocolate products, candy, chewing gum or a combination thereof, for example. Suitable bakery items may include biscuits, cookies, chips, crisps, dough-based products or the like. There may be a single food item or a plurality of food items, and there may be a combination of different food items, such as a combination of confectionery and bakery items, or of different confectionery items, for example. In some embodiments the food item is a block or bar of chocolate.

According to a fourth aspect of the present invention there is provided a packaging blank comprising front and back panels having opposing side edges and connected by a first side panel extending therebetween via a fold-line, one of the front and back panels also being connected to a second side panel extending along the opposite edge of the front or back panel to that connected to the first side panel via a fold-line, wherein the front and back panels include marginal sealing regions extending from each end thereof, and wherein at least a portion of an edge of at least one end of the side panels is not connected to the sealing regions at the ends of the front and back panels, and wherein each of the front, back and first and second side panels are formed substantially from cartonboard.

In some embodiments at least a portion of an edge of at least one end of both side panels is not connected to the marginal sealed regions, and in some embodiments at least a portion of an edge of both ends of both side panels is not connected to the marginal sealing regions.

In some embodiments there is provided a region at one or both ends of the side panels comprising at least one fold line, and in some embodiments there may be a plurality of fold lines in at least one of the end regions of the side panels. In other embodiments there is provided a plurality of fold lines in each end region of the side panels. There may be provided three fold lines in the end region of each side panel which forms a triangular fold-line assembly.

In some embodiments at least one edge of at least one end of the side panels may comprise at least one aperture or cut-out region located therein. The at least one aperture or cut-out region may comprise an aperture or cut-out region along a portion of the length of the at least one fold line, for example. In other embodiments the at least one aperture/cut-out region may be located on a free edge of the end region of the side panel.

In some embodiments there is provided more than one aperture or cut-out region in at least one of the end regions of the side panels. The plurality of apertures/cut-out regions may include both an aperture/cut-out region along a portion of the length of the at least one fold line, and an aperture or cut-out region located on a free edge of the end region of the side panel, for example.

In some embodiments at least one of the or each fold lines located in the end regions of the side panels comprises an aperture or cut-out region located along at portion of its length. In other embodiments all of the fold lines located within the end regions of the side panels comprise apertures/cut-out regions.

The blank may comprise one or more securement tabs or flaps, arranged to enable securement of the blank in a folded configuration after folding of the blank, in use. The securement tabs or flaps may comprise adhesive means, such as glue, adhesive, or the like, which may be thermal adhesive.

According to a fifth aspect of the invention there is provided a packaging blank comprising front and back panels having opposing side edges and connected by a first side panel extending therebetween via a fold-line, one of the front and back panels also being connected to a second side panel extending along the opposite edge of the first or back panel to that connected to the first side panel via a fold-line, wherein the first and second side panels comprise a gusseted region at each end thereof, and wherein the front and back panels include sealing regions at the ends thereof, at least a portion of the gusseted region of the side panels being adjacent to the sealing regions, and wherein each of the front, back and first and second side panels are formed substantially of cartonboard.

The sealing regions may comprise a region of the front and back panels defined by a crease or fold-line.

In some embodiments the gusseted regions of the side panels comprise a crease or fold-line extending therealong and may include a triangular fold arrangement extending from the crease or fold-line. The crease or fold-line may be located adjacent to the sealing regions of the front and back panels and may extend substantially the same distance as the longitudinal length of the sealing regions.

The blank may comprise one or more securement tabs or flaps, arranged to enable securement of the blank in a folded configuration after folding of the blank, in use. The securement tabs or flaps may comprise adhesive means, such as glue, adhesive, or the like, which may be thermal adhesive.

According to a sixth aspect of the invention there is provided a method of forming a packaging of the second aspect of the invention using a blank of the fourth or fifth aspect of the invention, comprising the steps of:

a) providing a blank of the fourth or fifth aspect of the invention;
b) folding and securing the front panel, back panel, and first and second side panels to form a tubular container; and
c) sealing the sealing regions of the front and back panels to form a sealed packaging.

In embodiments using a blank of the fourth aspect of the invention, step c) may comprise sealing the sealing regions of the front and back panels to form a partially sealed packaging comprising marginal sealed regions at each end, wherein at least a portion of an edge of at least one end of the side panels is not connected to the marginal sealed regions at the ends of the packaging.

In some embodiments the sealing regions are then crimped or embossed to form patterned sealing regions.

In some embodiments the method may further comprise placing at least one item on the inside surface of the front or pack panel before step b) or at least one item is placed in the container or packaging after step b).

DETAILED DESCRIPTION OF THE INVENTION

In order that the invention may be more clearly understood embodiments thereof will now be described, by way of example only, with reference to the accompanying drawings, in which.

Figure 1:
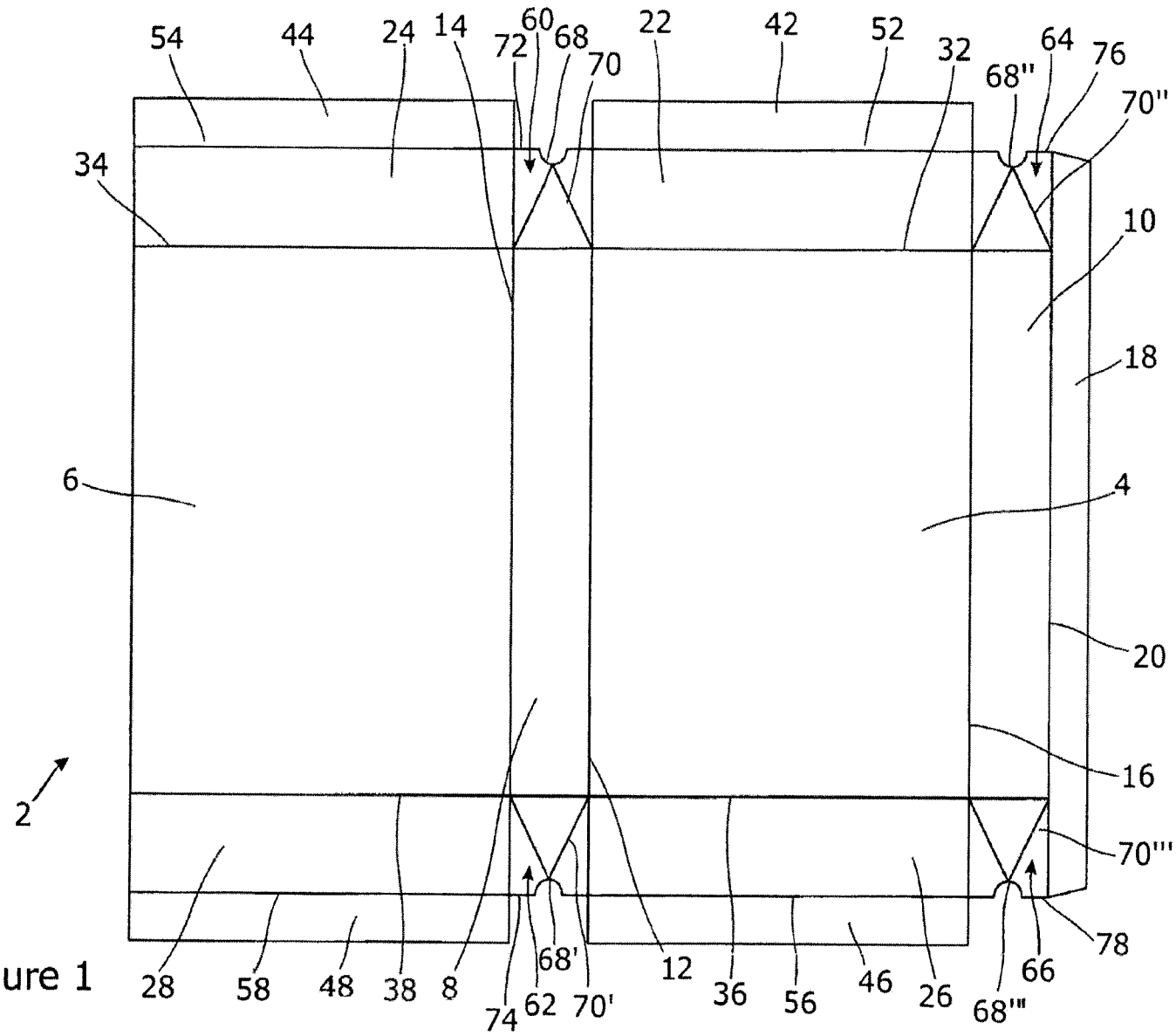
FIG. 1 illustrates a blank in accordance with the fourth aspect of the invention for an embodiment of a packaging of the invention.

A blank 2 of an embodiment of a packaging of the present invention will now be described with reference to FIG. 1. The blank 2 is formed from cartonboard and comprises a front panel 4 and a back panel 6 each comprising opposite longitudinal edges. Extending between the edges of the front and back panels 4, 6 is a first side panel 8 integrally formed with front and back panels 4, 6 and connected via fold lines 12, 14. Integrally formed with the opposite edge of the front panel 4 to which the first side panel 8 is connected is a second side panel 10 extending therealong, connected to the front panel 4 by fold line 16. Integrally formed with the opposite edge of the second side panel 10 to which the front panel 4 is connected is a securement tab 18. The securement tab 18 is connected to the edge of the second side panel 10 by fold line 20.

At the longitudinal ends of the front panel 4 and the back panel 6 are end regions 22, 24 at a first end, and end regions 26, 28 at the opposite end. The end regions 22, 24, 26, 28 are defined on the front 4 and rear 6 panels by respective fold lines 32, 34, 36, 38. Integrally formed with each end region 22, 24, 26, 28 are respective marginal sealing regions 42, 44, 46, 48 connected to their respective end region 22, 24, 26, 28 by fold lines 52, 54, 56, 58. The marginal sealing regions 42, 44, 46, 48 extend outwardly from their respective end regions 22, 24, 26, 28.

The first side panel 8 and second side panel 10 are provided with end regions 60, 62, 64, 66 at the ends thereof. End regions 60, 62 are located adjacent to the end regions 22, 24 and end regions 26, 28 respectively of the front and rear panels 4, 6. End regions 64, 66 are located adjacent to the end region 22 and end region 26 respectively of the front panel 4. The side panel end regions 60, 62, 64, 66 include respective apertures 68, 68', 68", 68''' at a point along their respective free edges 72, 74, 76, 78. Furthermore, each side panel end region 60, 62, 64, 66 includes a triangular fold-line assembly 70, 70', 70", 70'''.

A method of forming an embodiment of a packaging 100 in accordance with the present invention, using the blank as illustrated in FIG. 1, will now be described with reference to FIGS. 1 to 3.

Initially, the front and rear panels 4, 6 are folded along the fold lines 12, 14 such that they are spaced apart and opposing, whilst being perpendicular to the first side panel 8.

The second side panel 10 is subsequently folded along fold line 16 such that it too is orientated perpendicular to both the front panel 4 and the rear panel 6. Fold line 20 is also folded such that securement tab 18 is located within the volume defined by the front and rear panels 4, 6. In the illustrated embodiment, securement tab 18 is provided with an adhesive means such as an adhesive strip, a cold seal adhesive, hot melt adhesive or the like, and this is adhered to the inside the rear panel 6 in order to secure the front panel 4, rear panel 6, and side panels 8, 10 in a substantially tubular configuration.

In other embodiments the order of folding of the side panels 8, 10 and front 4 and back 6 panels may be performed in a different order, such as one side panel 8, 10 being folded about its respective fold lines 12, 14, 16, 20 before the front 4 and back 6 panels are folded, for example.

The end regions 22, 24, 26, 28 of the front and rear panels 4, 6 are brought together by folding fold lines 32, 34, 36, 38. In doing so, sealing regions 42, 44 and 46, 48 are brought together also. Marginal sealing regions 42, 46 of the front panel 4 are secured to the corresponding marginal sealing regions 44, 48 of the back panel 6 by pressing them together. An adhesive strip 200 is applied to at least one of the sealing regions at each end of the packaging 100. The adhesive strip 200 may comprise a hot melt adhesive or other suitable adhesive. As the marginal sealing regions 42, 46 and 44, 48 are pressed together, end regions 60, 62, 64, 66 of the first and second side panels 8, 10 fold about their respective triangular fold-line assemblies 70, 70', 70", 70''' to form gabled end regions 102, 104, 106, 108 having openings formed therein by apertures 68, 68', 68", 68''' along the respective free edges 72, 74, 76, 78 of end regions 60, 62, 64, 66. The triangular fold line assemblies 70, 70', 70", 70''' enable the folding of the end regions 60, 62, 64, 66 without affecting the orientation of the first and second side panels 8, 10 which remain substantially perpendicular to the front panel 4 and rear panel 6.

Figure 3:
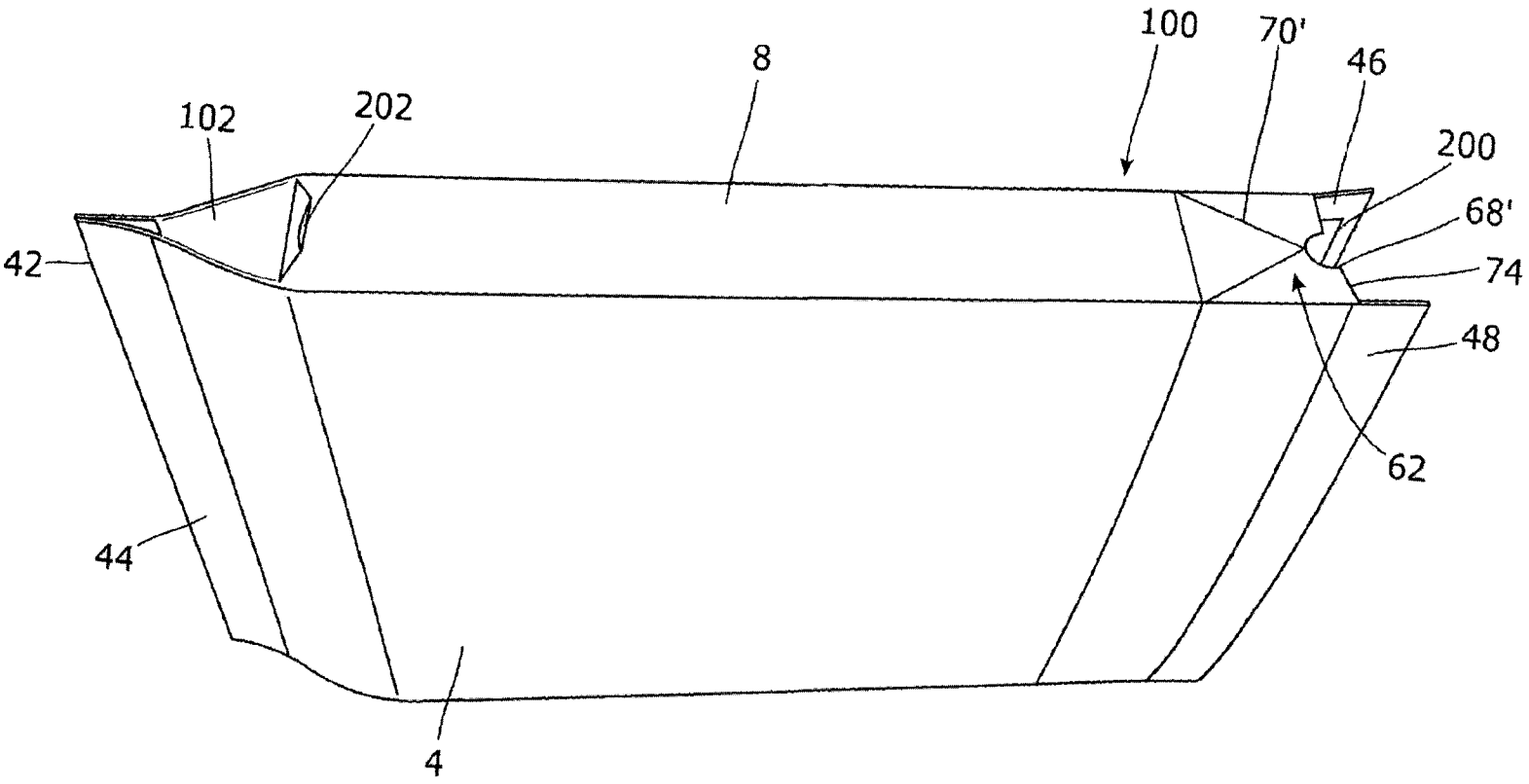
FIG. 3 is a perspective view of the packaging of the invention formed from the blank of FIG. 1.

Gabled end region 102, as illustrated in FIG. 3, also comprises a further opening 202. This further opening 202 is formed by providing an aperture/cut-out region in the end region 60 of side panel 8. This aperture/cut-out region may be provided along at least a portion of the length of one of the fold lines forming the triangular fold line assembly 70. Further apertures/cut out regions may be provided along the length of one or both of the other two fold lines forming the fold line assembly 70.

Although illustrated as only providing an opening 202 within gabled end region 102, it is to be appreciated that further openings may be provided in at least one further gabled end region 104, 106, 108. These further openings may be formed by providing apertures/cut-out regions along at least a portion of the length of at least one fold line forming triangular fold line assemblies 70', 70", 70'''.

As the marginal sealing regions 42, 44, 46, 48 are secured together, they may also be embossed using suitable sealing jaw patterns, in order to provide an embossed pattern. In alternative embodiments, an image of an embossing pattern may be printed on the marginal sealing regions 42, 44, 46, 48 in place of actual embossing of the regions.

In use, while the packaging 100 is in the substantially tubular configuration described hereinabove, and after one end of the tubular configuration has been sealed, as illustrated in FIG. 3, the open end of the packaging 100 can be utilised to fill the packaging 100 with products or items such as, for example, confectionery or bakery items. In alternative embodiments, the interior of the packaging may be provided with an item, such as a bar or a tablet of chocolate, placed on the inside surface of the front panel 4 or back panel 6 before the packaging 100 is folded to the final, sealed configuration.

Figure 2:
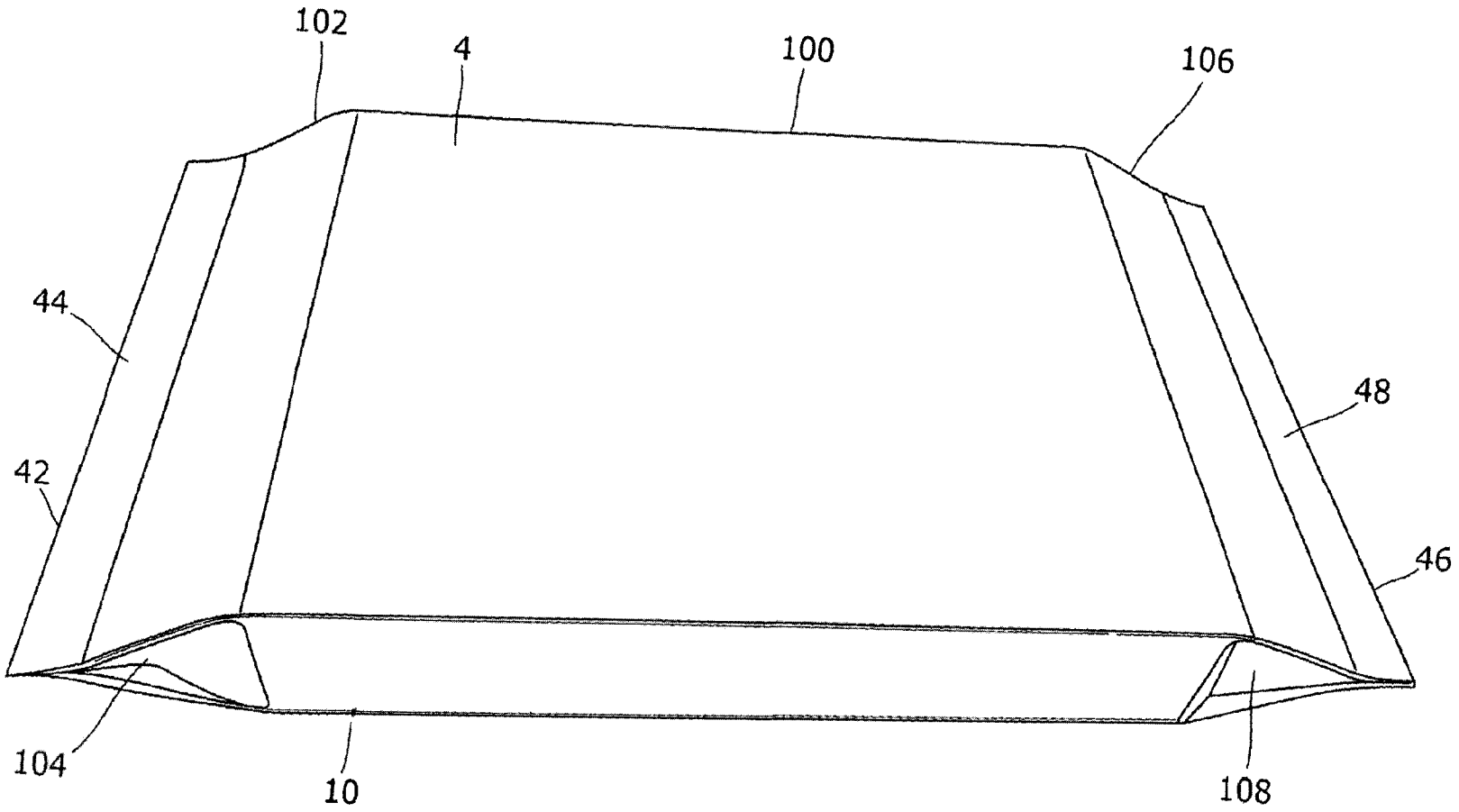
FIG. 2 is a perspective view of the packaging of the invention formed from the blank of FIG. 1.

In alternative embodiments of the packaging blank/packaging shown in FIGS. 1 to 3, the marginal sealing regions 42, 44, 46 and 48 may be provided with a thermo-sealant layer, such as a polyethylene thermo-sealant which is used as an adhesive. Any adhesive may be formed from adhesive strips directly deposited on to the sealing regions, laminated film or the like.

In yet other embodiments, the first and second side panels 8, 10 may be provided with a fold-line along the entire length thereof, so that the entirety of the first 8 and/or second 10 side panels can be folded in order to enable the packaging to fold relatively flat before or during use. Any fold-line extending along the entirety of the first and second side panels 8, 10 may also be used to provide non-planar shape to the first and second side panels 8, 10.

In still further embodiments, some of the components, such as the side panels 8, 10 and end regions 22, 24, 26, 28 may be connected to rather than integral with the front panel 4 and back panel 6, and may be adhered or secured via suitable adhesive means. In some embodiments, some of the components, such as sealing regions 42, 44, 46, 48 and/or end regions 60, 62, 64, 66 may be connected to rather than integral with the end regions 22, 24, 26, 28 or the side panels 8, 10 respectively, and may be adhered or secured via suitable adhesive means.

In yet further embodiments, at least one of the fold lines forming each of the triangular fold line assemblies 70, 70', 70", 70''' may comprise an aperture located therein to form further openings in the gabled end regions 102, 104, 106, 108 of the formed packaging 100.

Figure 4:
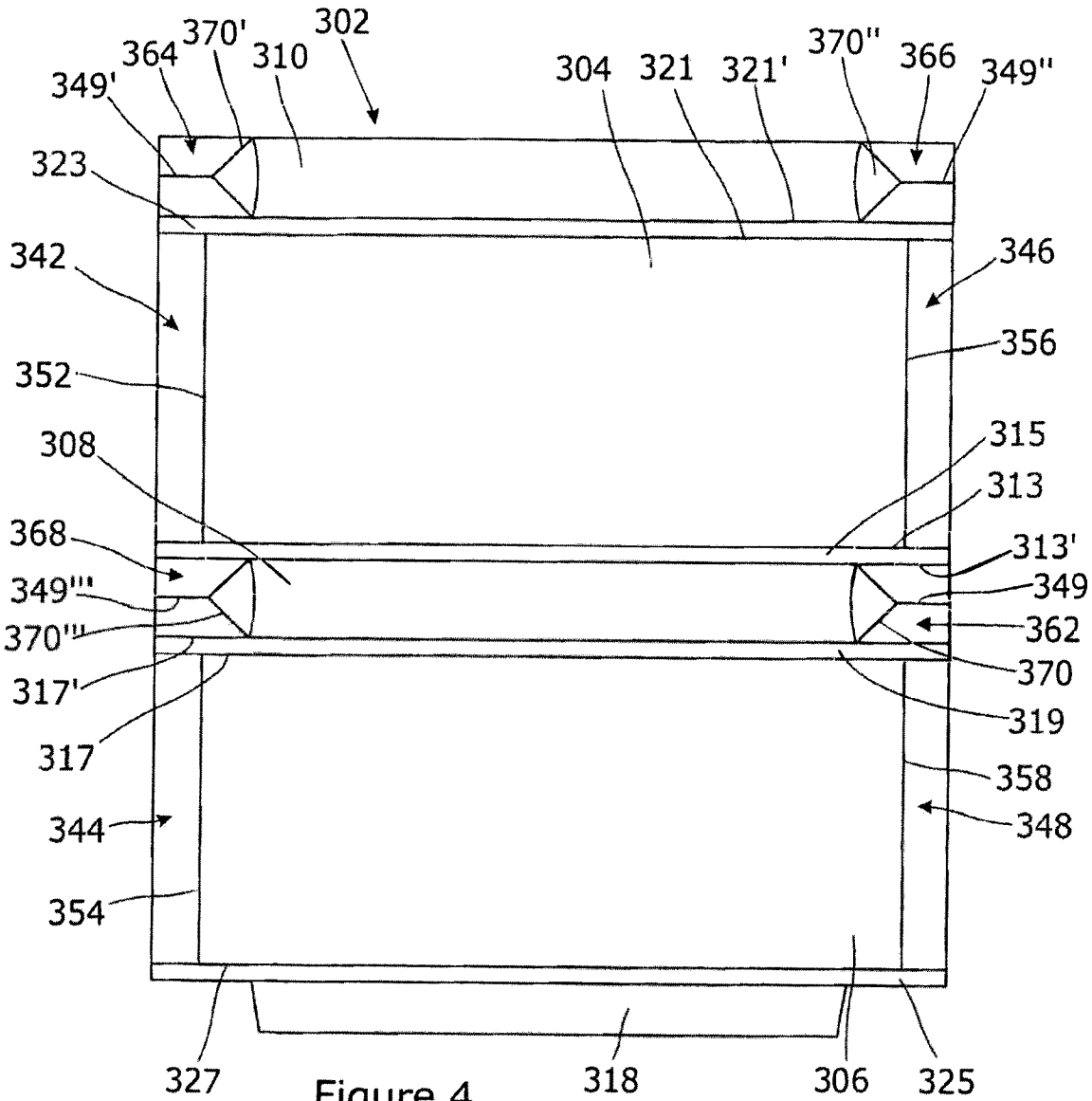
FIG. 4 illustrates a blank in accordance with the fifth aspect of the invention for an embodiment of a packaging of the invention.

FIG. 4 illustrates a blank 302 of another embodiment of a packaging of the present invention. The blank 302 is formed from cartonboard and comprises a front panel 304 and back panel 306 each comprising opposite longitudinal edges. The front 304 and back 306 panels are substantially rectangular in shape. Extending between edges of the front 304 and back 306 panels is a first side panel 308 which is integrally formed with the front 304 and back 306 panels. Connected to the opposite edge of the front panel 304 to which the first side panel 308 is connected is a second side panel 310 extending therealong. The first side panel 308 is separated from the front panel 304 and back panel 306 via fin regions 315 and 319 respectively, formed via respective fold-lines 313, 313' and fold-lines 317, 317', arranged in use to form the fin regions 315, 319. Likewise, the second side panel 310 is connected to the front panel 304 via a fin region 323 formed between fold lines 321, 321', which are arranged to fold and form the fin region 323 in use. A fin region 325 also extends along the free edge of the back panel 306, formed from a fold-line 327. At the distal edge of the fin 325 is a securement tab 318, arranged in use to be secured beneath the second side panel 310 in use.

At the longitudinal ends of the front panel 304 and back panel 306 are marginal sealing regions 342, 344 at one end and marginal sealing regions 346, 348 at the other end. The sealing regions 342, 344, 346, 348 extend up to the fin regions 323, 315, 319 and 325. The extent of the sealing regions 342, 344, 346, 348 is defined by transverse fold-lines 352, 354, 356, 358 extending across the front panel 304 and back panel 306 towards the longitudinal ends thereof.

The first side panel 308 and second side panel 310 are provided with gusseted regions 362, 364, 366, 368 at the ends thereof. The gusseted regions 362, 364, 366, 368 include a central fold-line 349, 349', 349", 349''' extending from the distal edge thereof and ending in a triangular fold-line assembly 370, 370', 370", 370''', The fold-lines 349, 349', 349", 349''' extend along the first 308 and second 310 side panels to a distance substantially identical to the length of the sealing portions 342, 344, 346, 348 of the front 304 and back 306 panels.

The back panel 306 also includes a securement tab 318 arranged to be adhered to the second side panel 310 in use.

Formation of the embodiment of the packaging 300 shown in FIG. 5 from the blank 302 will now be described.

Firstly the front panel 304 and rear panel 306 are folded along the fold-lines 313 and 317 such that the front 304 and rear 306 panel are spaced apart and opposing, and perpendicular to the first side panel 308. The first side panel 308 is then folded about the longitudinal fold-lines 313', 317' such that the fins 315, 319 are formed and the first side panel 308 rests below the peripheral edges thereof.

The second side panel 310 is then folded about the fold-line 321 and fold-line 321' in order to provide the fin region 323, and orient the second side panel 310 perpendicular and beneath the front 304 and back 306 panels. The fold-line 327 extending along the free edge of the back panel 306 is then folded, and the securement tab 318 folded between the interior formed by the front panel 304 and back panel 306, and the second side panel 310. The securement flap 318 is provided with an adhesive means such as an adhesive strip, a cold seal adhesive, hot melt adhesive or the like, and this is adhered to the inside the second panel 310, in order to secure the front panel 304, back panel 306 and first and second side panels 308, 310 in a substantially tubular configuration.

In other embodiments the order of folding of the side panels 308, 310 and front 304 and back 306 panels may be performed in a different order, such as one side panel 308, 310 being folded about its respective fold lines 313', 317', 321, 321' before the front 304 and back 306 panels are folded, for example.

In order to seal the ends of the now substantially tubular packaging 300, the sealing regions 342 and 346 of the front panel 304 are secured to the sealing regions 344, 348 of the back panel 306 and pressed together to seal the regions together. Hot melt adhesive or other suitable adhesive is applied to at least one of the sealing regions at each end of the packaging 300. As the regions 342, 346 and sealing regions 344, 348 are pressed together, the gusseted regions 362, 364, 366, 368 of the first and second side panels 308, 310 fold about the gusset fold lines 349, 349', 349", 349'", in order that the packaging 300 is fully sealed at each of the four corners formed at the edge of the sealing regions 342, 344 and sealing regions 346, 348. The triangular gusset assembly 370, 370', 370" and 370'" enables the folding of fold-lines 349, 349', 349", 349'" without affecting the orientation of the first and second side panels 308, 310 substantially perpendicular to the front panel 304 and rear panel 306.

As with the embodiment illustrated in FIGS. 1 to 3, many variations are possible, and include, but are not limited to the following.

Figure 5:
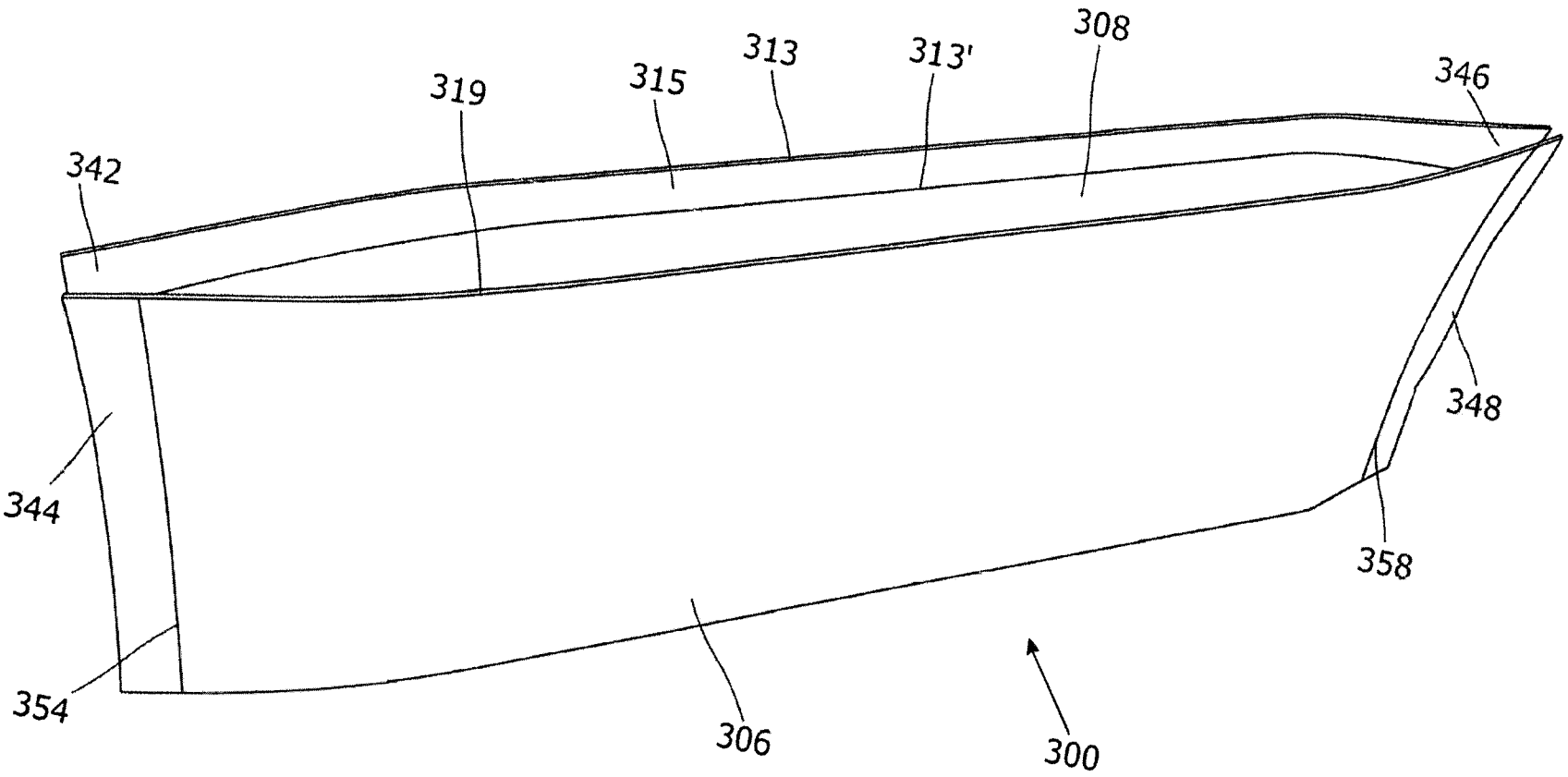
FIG. 5 is a perspective view of the packaging of the invention formed from the blank of FIG. 4.

As the sealing regions 342, 344, 346, 348 are secured together, they may also be embossed using suitable sealing jaw patterns, in order to provide an embossed pattern as shown in FIG. 5. The resultant fully formed packaging 300 is as shown in FIG. 5. In alternative embodiments, an image of an embossing pattern may be printed on the sealing regions 342, 344, 346, 348 in place of actual embossing of the regions.

In use, while the packaging 300 is in the substantially tubular configuration described hereinabove, and after one end of the tubular configuration has been sealed, the open end of the packaging 300 can be utilised to fill the packaging 300 with products or items such as, for example, confectionery or bakery items. In alternative embodiments, the interior of the packaging may be provided with an item, such as a bar or a tablet of chocolate, placed on the inside surface of the front panel 304 or back panel 306 before the packaging 300 is folded to the final, sealed configuration.

In alternative embodiments of the packaging shown in FIGS. 4 and 5, the sealing portions 342, 344, 346, 348 may be provided with a thermo-sealant layer, such as a polyethylene thermo-sealant which is used as an adhesive. Any adhesive may be formed from adhesive strips directly deposited on to the sealing regions, laminated film or the like.

In yet other embodiments, the first and second side panels 308, 310 may be provided with a gusset fold-line along the entire length thereof, so that the entirety of the first 308 and or second 310 side panels can be folded in order to enable the packaging to fold relatively flat before or during use. Any gusset fold-line extending along the entirety of the first and second side panels 308, 310 may also be used to provide non-planar shape to the first and second side panels 308, 310.

In still further embodiments, some of the components, such as the sealing regions, side panels 308, 310 and gusset regions 362, 364, 366, 368 may be connected to rather than integral with the front panel 304 and back panel 306, and maybe adhered or secured via suitable adhesive means.

The use of end sealing regions 342, 344, 346, 348, combined with gusset portions 362, 364, 366, 368 of the side panels 308, 310, or end regions 22, 24, 26, 28 of the front and rear panels 4, 6 and marginal sealing regions 42, 44, 46, 48, combined with end portions 60, 62, 64, 66 of the side panels 8, 10 enables a cartonboard packaging to be manufactured and constructed which can mimic the shape and orientation of a flexible flow-wrap packaging manufactured by standard horizontal or vertical form, fill and seal processes.

In addition, the presence of the peripheral fin portions 315, 319, 323, 325 extending upwardly from along the longitudinal edges of the front panel 304 and rear panel 306 as illustrated in FIGS. 4 and 5 enable the cartonboard packaging 300 of the invention to appear to be manufactured using flexible flow-wrap technologies, whilst maintaining stability and rigidity in order that the packaging 300 of the invention can be stood securely along its first and second side panels 308, 310.

Furthermore, the packaging 100, 300 maybe decorated in any suitable manner with branding and artwork, which will enable masking the cartonboard appearance, further helping to give the packaging the impression of being produced in a flow-wrap process.

The above embodiments are described by way of example only. Many variations are possible without departing from the scope of the invention as defined in the appending claims.

The invention claimed is:

1. A packaging formed from a single unitary blank of cartonboard and comprising opposing and spaced apart front and back panels separated by side panels extending therebetween, a region at each end of the side panels comprising a gusseted region, wherein a marginal region of each end of the front and back panels is sealed together and with the gusseted regions of the side panels form sealed end regions of the packaging, and the packaging comprises fins extending along junctions of the front and back panels with the side panels, wherein a first pair of the fins projecting in a first direction from a first of the side panels and a second pair of the fins projecting in a second direction from a second of the side panels, and wherein the first and second directions are different, wherein the first pair of fins have parallel segments, and wherein the second pair of fins have parallel segments.

2. A packaging as claimed in claim 1 wherein the marginal region of each end of the front and back panel comprises an integral marginal region or a fin region connected or integral with the panels.

3. A packaging as claimed in claim 1 wherein the side panels are gusseted and comprise a crease or fold-line extending therealong.

4. A packaging as claimed in claim 1 wherein the marginal gusseted region of the side panels comprises a crease or fold-line.

5. A packaging as claimed in claim 1 wherein the marginal regions of the front and back panels are sealed by way of a peelable or reclosable adhesive.

6. A packaging as claimed in claim 1 wherein the sealed marginal regions of the front and back panels are crimped or embossed along at least a portion thereof.

7. A packaged product comprising packaging of claim 1 containing at least one product or item.

8. A packaged product as claimed in claim 7 wherein the product or item is a food item selected from a confectionary item, bakery item, fruit, vegetable, meat, cheese, beverage, powdered food, powdered beverage and snack item.

9. A unitary packaging blank for forming a packaging as claimed in claim 1, the front and back panels having opposing side edges and connected by the first side panel extending therebetween via a fold-line, one of the front and back panel also being connected to the second side panel extending along the opposite edge of the front or back panel to that connected to the first side panel via a fold-line, wherein the first and second side panels comprise the gusseted region at each end thereof and wherein the front and back panels include the sealing end regions at each end thereof, at least a portion of the gusseted region of the side panels being adjacent to the sealing end regions, the blank further comprising a first fin panel extending between the first side panel and the front panel and connected thereto by respective fold lines, a second fin panel extending between the first side panel and the rear panel and connected thereto by respective fold lines, a third fin panel extending between the second side and the one of the front and rear panels and connected thereto by respective fold lines, and a fourth fin panel extending along a free edge of the other of the front and rear panels and connected thereto by a fold line.

10. A unitary packaging blank as claimed in claim 9 comprising a securement tab extending along a distal edge of the fourth fin panel and connected thereto by a fold line to enable securement of the blank in a folded configuration after folding of the blank.

11. A packaging as claimed in claim 1 wherein the first direction is opposite the second direction.

12. A packaging formed from a single unitary blank of cartonboard and comprising opposing and spaced apart front and back panels separated by side panels extending therebetween, a region at each end of the side panels comprising a gusseted region, wherein a marginal region of each end of the front and back panels is sealed together and with the gusseted regions of the side panels form sealed end regions of the packaging, and the packaging comprises fins extending along junctions of the front and back panels with the side panels, wherein a first pair of the fins projecting in a first direction from a first of the side panels and a second pair of the fins projecting in a second direction from a second of the side panels, and wherein the first and second directions are different, wherein the first pair of the fins extend along the entirety of the length of the first of the side panels and the second pair of the fins extend along the entirety of the length of the second of the side panels.

* * * * *